US005842228A

United States Patent [19]

Krainin

[11] Patent Number: 5,842,228

[45] **Date of Patent: *Dec. 1, 1998**

[54] NAPKIN HOLDER

[76] Inventor: Harold Krainin, 5 Kissam La., Glen Head, N.Y. 11545

[ * ] Notice: This patent issued on a continued prosecution application filed under 37 CFR 1.53(d), and is subject to the twenty year patent term provisions of 35 U.S.C. 154(a)(2).

[21] Appl. No.: 735,223

[22] Filed: Oct. 22, 1996

[51] Int. Cl.[6] ..... A41B 13/10

[52] U.S. Cl. ..... 2/46; 2/49.1; 2/48; 2/243.1; 2/300

[58] Field of Search ..... 2/46, 48, 49.1, 2/49.2, 49.3, 49.4, 49.5, 50, 51, 52, 311, 312, 338, 174, 269, 243.1

[56] References Cited

U.S. PATENT DOCUMENTS

| | | | |
|---|---|---|---|
| 2,145,139 | 1/1939 | Scharfenberg | 2/52 |
| 2,292,024 | 8/1942 | Dreher | 450/81 |
| 2,902,734 | 9/1959 | Walters | 2/52 |
| 3,619,816 | 11/1971 | Cowen | 2/48 |
| 4,288,877 | 9/1981 | Klepfer | 2/48 |
| 4,622,698 | 11/1986 | Heyman et al. | 2/48 |
| 4,958,385 | 9/1990 | Rushton, Jr. | 2/174 |
| 5,220,692 | 6/1993 | Cox | 2/52 |
| 5,535,453 | 7/1996 | Howard | 2/269 |
| 5,539,932 | 7/1996 | Howard | 2/269 |
| 5,706,524 | 1/1998 | Herrin et al. | 2/311 |

*Primary Examiner*—Jeanette Chapman
*Attorney, Agent, or Firm*—Bauer & Schaffer

[57] ABSTRACT

A neck band for holding napkins, bibs and the like on the chest of the user. The neck band is formed of a strip of disposable material, such as paper provided with a tab of self-adhesive material at each end, by which the strip can be attached to the napkin, bib etc.

2 Claims, 1 Drawing Sheet

NAPKIN HOLDER

BACKGROUND OF THE INVENTION

The present invention relates to the provision of disposable "one shot" holders for napkins, bibs and protective towels.

The present invention is particularly adaptable for holding napkins in commercial environments to allow customers to hold their napkins in place while eating and will be described in connection therewith. However, it will be apparent that the invention is equally adaptable for other uses, such as adult and child bibs, dental hygienic bibs and the like, and is not limited in its application.

Disposable napkins made of paper are known and may be considered for "one shot" use. Lightweight plastic napkins or "lobster bibs" formed by stamping a neck band and body member from a single sheet of thin plastic are also known. Because such devices are made of paper or lightweight plastic, they are rather flimsy, ill-fitting and of unpleasant appearance, they are not acceptable to most moderate and high price consumers.

Furthermore, most restaurant customers prefer to use cloth napkins. Cloth napkins, however, do not normally come with integral neck bands, and, therefore, are difficult to use to protect the chest and frontal body of the wearer. Attempts have been made to provide neck bands formed of chains with clips, pins and other more or less permanent attachment means. Furthermore, such neck bands are difficult to make and, therefore, are expensive. Consequently, they are not readily disposable nor can they be used as "one-shot" devices.

Reference can be made to such prior art devices, as are shown in U.S. Pat. Nos. 1,551,829; 2,571,888; 2,622,246; 2,835,895; 3,010,110; 3,619,816 and 5,414,903.

It is an object of the present invention to provide disposable "one shot" neck band for use with non-disposable napkins.

It is an object of the present invention to provide a disposable neck band to which a napkin, bib, towel, and the like may be attached, and which may be quickly disposed of without the disposal of the napkin.

It is a further object of the present invention to provide a disposable "one shot" neck band which can be easily attached and removed from cloth napkins without damage or marring of the cloth.

These and other objects and advantages will be apparent from the disclosure of the invention set forth hereinafter.

SUMMARY OF THE INVENTION

According to the present invention a neck band is made of a strip of disposable lightweight paper, or plastic, of sufficient length to extend about the neck of the user. The strip is provided at each of its ends with a layer of self-adhesive material which adheres freely to the strip and which, when placed in contact with the cloth napkin adheres securely to the napkin. The self-adhesive layer is preferably covered by a release strip which prevents unwanted adhesion and which is easily removable for use. Thus, the neck band may be removably attached to the napkin.

These objects, as well as others, together with the several advantages of the present invention, will be apparent from the following disclosure.

DESCRIPTION OF THE INVENTION

Figure 1:
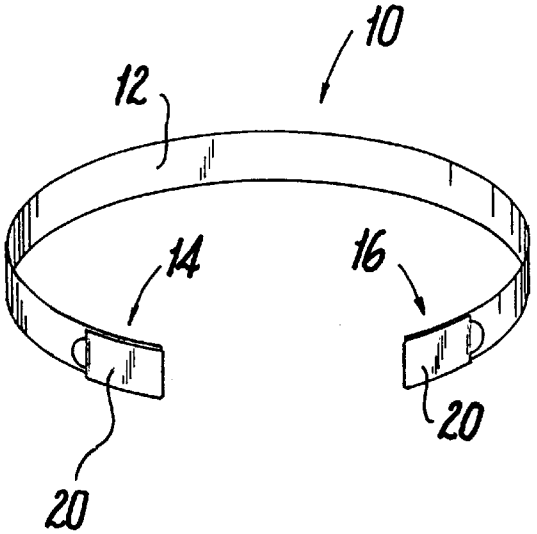
FIG. 1 is a perspective view of the neck band.

As seen in FIG. 1, the neck band, generally depicted by the numeral 10, comprises a strip 12 of disposable material such as paper, plastic or the like. The strip may be anywhere from 1 to 3 inches wide, as desired and of sufficient length (13–20 inches or so) so as to fit comfortably about the neck of a wearer and hanging downward over the users chest.

The paper, plastic or other material from which the strip 10 is made is not critical to the invention, except that it must have sufficient strength in the lengthwise direction so as not to be capable of being pulled out of shape or unduly elongated and not to tear easily.

Preferably, the material used for the strip 12 should be capable of being printed on or otherwise accept and retain visual indicia, such as a logo, trademark or advertisement of the establishment in which it is being used, or of another advertisement. The material may be colored or otherwise decorated.

At each end 14 and 16 of the strip 12, a layer of self-adhesive 18 is firmly secured to the outer surface of the strip. The layer of the material is covered by a release tab 20 so that the exposed surface remains clean and protected against unwanted adhesion to another object.

The self-adhesive layer is formed of conventional material readily available at wholesale and retail establishments. For example, a double-sided SCOTCH TAPE Trademark of the 3M corporation may be used. The release layer may be a silicon plastic or paper coated with this or another non-stick material.

Figure 2:
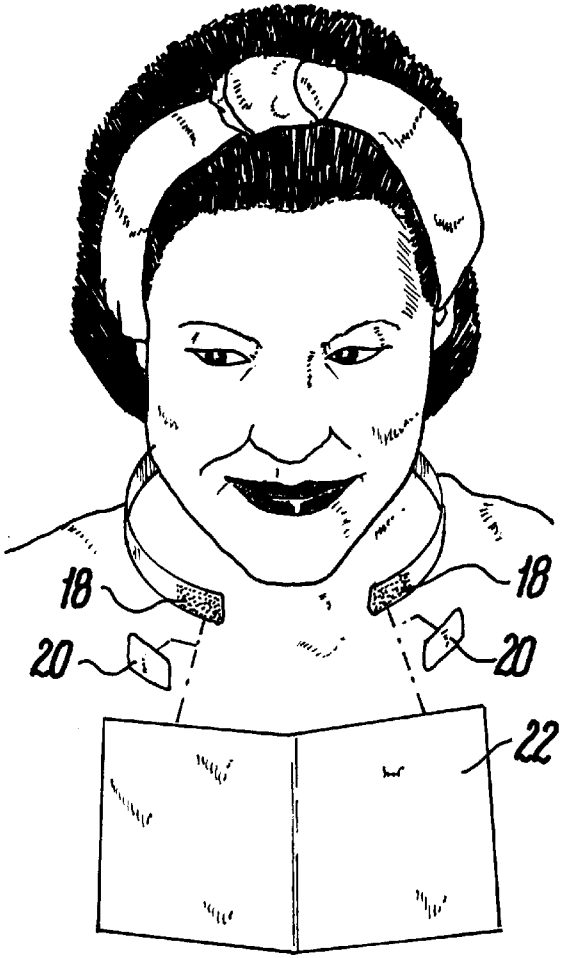
FIG. 2 is a perspective view of a person wearing the present invention.

As seen in FIG. 2, the neck band 10 is employed in conjunction with a napkin 22 and is applied to wearer the simultaneously with the napkin. In doing so each of the release tabs 20 is removed and the adhesive layer 18 pressed into contact with the surface of the napkin along the napkin's upper edge. Preferably, the layer of adhesive 18 is placed on the outer surface of the strip 12 (usually defined by which surface has the visual indicia most desired to be seen) so that the strip 12 is secured to the rear surface of the napkin 22 and thereby the ends 14 and 16 of the neck band are not visible in use.

Figure 3:
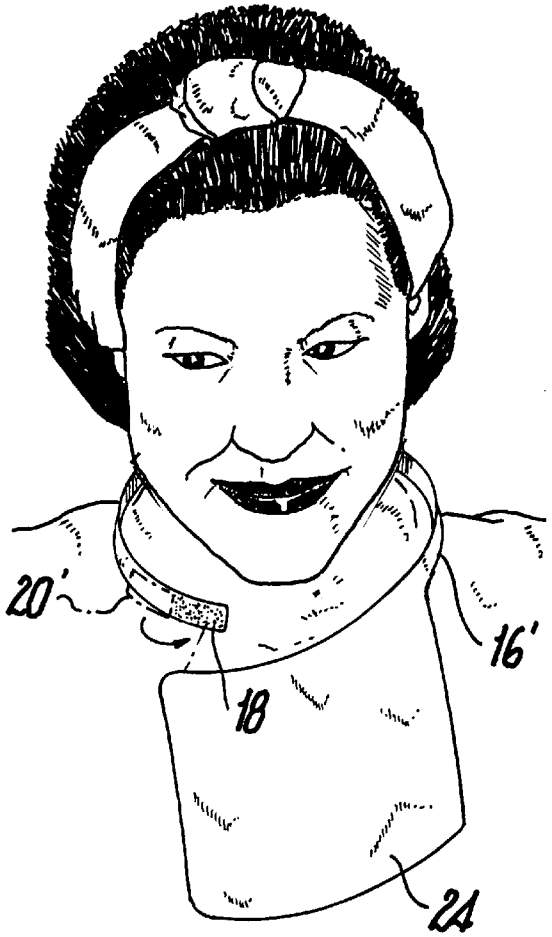
FIG. 3 is a similar view showing an embodiment of the invention.

In the modification seen in FIG. 3, a neck band 30, otherwise the same as that shown in FIG. 1 is attached at one end 16' integrally with a napkin 24 so as to create an integral napkin and neck band system. The free end 14 of the strip 12 is provided with the adhesive layer 18 so that the neck band 10 can first be placed about the neck of the wearer concomitantly with the placing of the napkin 24, both then can be secured in place.

FIG. 3 shows another variant which may also be used with the embodiment of FIG. 1. In this variant, the adhesive layer 18 is not covered by a release tab, but is merely folded over to lie against the outer surface of the strip 12. In this case the strip itself must be made of a material, or its outer surface be applied with a non-stick surface acting as a release tab 20'. It will, thus be seen that the present invention provides a simple, easily structured neck band, which may then be easily attached to cloth, paper or plastic napkins, bibs and other protective covers. No pins, metal fasteners or clips are employed and the neck band is relatively cheap, making it truly a "one shot" disposable.

Further, the neck band may be supplied separately from the napkins. This shipping and storage is simplified. Even the embodiment where the neck band is secured at one end provides great advantage in manufacture, storage and shipping.

Various modifications and changes have been disclosed herein, and others will be apparent to those skilled in this art. Therefore, it is to be understood that the present disclosure is by way of illustration and not limiting of the present invention.

What is claimed is:

1. A bib comprising the combination of a single use disposable neck band and a non-disposable napkin said neck band comprising a strip of disposable material having sufficient strength in the lengthwise direction so as not to be capable of being pulled out of shape, unduly elongated or torn, said strip having a tab at each end, each of said tabs having a surface of self-adhesive material exposable in use for adhesion to said napkin whereby said strip may be removably secured to said napkin.

2. The neck band according to claim 1, wherein said self-adhesive tab is covered with a sheet of release paper.

* * * * *